United States Patent [19]

Lindner

[11] Patent Number: 4,500,264

[45] Date of Patent: Feb. 19, 1985

[54] AIR OPERATED DIAPHRAGM PUMP SYSTEM

[75] Inventor: Georg H. Lindner, Vlissingen, Netherlands

[73] Assignee: M&T Chemicals Inc., Woodbridge, N.J.

[21] Appl. No.: 385,176

[22] Filed: Jun. 4, 1982

[51] Int. Cl.[3] ..... B67D 5/50

[52] U.S. Cl. ..... 417/395; 92/97; 222/385

[58] Field of Search ..... 417/390, 395, 383, 392; 222/385; 92/97

[56] References Cited

U.S. PATENT DOCUMENTS

| | | | |
|---|---|---|---|
| 2,050,526 | 8/1936 | Gleason | 417/392 X |
| 2,188,646 | 1/1940 | Bunch | 222/385 X |
| 2,606,696 | 8/1952 | Miner | 222/385 X |
| 3,013,575 | 9/1959 | Persson . | |
| 3,131,639 | 5/1964 | Huigens | 222/385 X |
| 3,148,624 | 9/1964 | Baldwin . | |
| 3,240,152 | 3/1966 | Bower, Jr. . | |
| 3,285,182 | 11/1966 | Pinkerton . | |
| 3,317,141 | 5/1967 | Mann | 222/385 X |
| 3,405,645 | 10/1968 | Jackson | 417/390 |
| 3,461,808 | 8/1969 | Nelson et al. . | |
| 3,514,227 | 5/1970 | Rupp . | |
| 3,666,379 | 5/1972 | Mitchell et al. | 417/395 |
| 3,765,802 | 10/1973 | Leitermann et al. | 417/395 |
| 3,781,141 | 12/1973 | Schall | 417/395 |
| 3,814,548 | 6/1974 | Rupp | 417/395 |
| 3,816,034 | 6/1974 | Rosenquest, Jr. | 417/395 |
| 4,021,149 | 5/1977 | Rutenberg et al. | 417/395 |
| 4,021,164 | 5/1977 | Tell | 417/395 X |
| 4,042,311 | 8/1977 | Yonezawa | 417/401 |
| 4,093,406 | 6/1978 | Miller | 417/401 |
| 4,104,008 | 8/1978 | Hoffmann et al. | 417/397 |

FOREIGN PATENT DOCUMENTS

| | | | |
|---|---|---|---|
| 7105052 | 10/1971 | Netherlands . | |
| 1112507 | 5/1963 | United Kingdom | 417/395 |
| 1234921 | 6/1971 | United Kingdom | 417/395 |

*Primary Examiner*—Leonard E. Smith

*Attorney, Agent, or Firm*—S. A. Marcus; S. H. Parker; J. Matalon

[57] ABSTRACT

An air-operated diaphragm pump assembly for withdrawing small volumes of liquid from a receptacle until the receptacle is almost completely emptied. The pump assembly includes a diaphragm pump that is submerged within the liquid in one receptacle, an extension sleeve extending upwardly from the pump to a position above the receptacle, fluid logic circuitry to operate the pump, inlet conduit(s) passing through the sleeve to transmit control pulses to the pump, and outlet conduit(s) passing through the sleeve to discharge the liquid forced out of the pump in response to the control pulses. The fluid logic circuitry includes a pneumatic Schmitt-Trigger that is operatively associated with a pneumatic inverter. The diaphragm pump includes a pumping diaphragm and a driving diaphragm, the diaphragms being coupled together to drive a displacer within a pumping chamber in response to a pressure differential to thereby expel the liquid contained therein.

3 Claims, 7 Drawing Figures

AIR OPERATED DIAPHRAGM PUMP SYSTEM

BACKGROUND OF THE INVENTION

1. Field of the Invention

The present invention relates generally to a diaphragm pump system for delivering small volumes of liquids, and more particularly to an air operated diaphragm pump system that employs fluid logic circuitry to drive a diaphragm pump submerged within the liquid to be discharged.

2. Prior Art

The need to (1) effectively drain all of the fluid present in a storage drum, or other vessel, and to (2) discharge same at a constant rate, is a frequently occurring problem arising in diverse industrial situations. One conventional solution of this problem is to employ a reciprocating displacement pump. Such pump is secured to the storage vessel above the liquid level, and a conduit depends below the pump into the liquid. Electrical or hydraulic control signals are supplied to an operator for the pump, and the pump functions to draw fluid upwardly through the conduit and discharge same through an outlet port. One representative prior art pump is disclosed in U.S. Pat. No. 3,285,182, granted Nov. 15, 1966, to Harry E. Pinkerton, and another representative prior art pump is disclosed in U.S. Pat. No. 3,814,548, granted June 4, 1974 to Warren E. Rupp.

Known small reciprocating pumps, however, require a priming action before the liquid can be pumped from the storage vessel. Larger reciprocating positive displacement pumps may have such a capability designed therein. More specifically, the larger pumps realize high ratios of displaced volume per stroke to the total volume of the conduits between the inner and outlet valves of said pumps. Such high ratios are unobtainable in known small reciprocating pumps for the conduits must be greater in size than the theoretical minimums if the pumps are to function satisfactorily. An alternative response to the priming problem is to connect the inlet side of the pump to the storage vessel in a liquid-tight manner, and to then manually or mechanically manipulate the vessel so that the liquid level within the drum is elevated above the inlet connection and the pump. The alternative response obviously calls for repeated handling of the storage vessel with attendant increased operating costs.

SUMMARY OF THE INVENTION

With the deficiencies of the conventional positive displacement pumps clearly in mind, the present invention contemplates an air operated diaphragm pump system that will effectively drain substantially all of the fluid present in a storage drum or the like, and discharge same in a series of liquid pulses that approximates a continuous stream. The diaphragm pump of the present system is submerged within the liquid in the drum with its inlet port adjacent to the bottom thereof, thus obviating the usual requirement for an inlet conduit leading to a pump positioned above the liquid level and minimizing, if not eliminating, priming problems. Furthermore, the present diaphragm pump is sealed in a leakproof manner so that the pump is virtually immune from attack by the corrosive or contaminated liquids within which it may be submerged.

The present system includes an extension sleeve which projects upwardly from the submerged pump and terminates at a location spaced above the drum.

The extension sleeve encloses the conduits leading from a remotely situated pulse generator to the submerged pump, and also encloses a conduit leading from the pump to a delivery point, which may assume the form of a discharge nozzle, atomizer, or the like. The sleeve, which may be fabricated from a rigid or semi-rigid metal or plastic, passes through an aperture in the cover for the drum and protects the conduits from attack by the liquid contained in the drum.

The present system includes a pulse generator that utilizes fluid logic circuitry to provide control pulses of air for operating the diaphragm pump in the desired manner. The diaphragm pump includes a driving membrane, a pumping membrane, and a displacer operatively associated with the membranes. The logic circuitry supplies pressure pulses to the driving membrane for the displacement strokes, whereas reversed pressure pulses are fed in between both membranes to effect the return strokes. The displacer comprises a cap, a spacer, and a clamping plate, which are joined together by a fastener that is threaded into an axially extending bore in the displacer. The cap expels the fluid retained in a chamber in the pump body in response to the application of a pressure pulse to the driving membrane.

The present system is relatively simple, inexpensive to produce, install and maintain, and yet is capable of draining almost all of the fluid contained within a drum or other storage vessel and discharging same at a constant rate of but a few liters per day. Furthermore, the logic circuitry can be readily adjusted so that the rate of fluid discharge can be altered over a range of values. Additional advantages of the present system will become readily apparent to the skilled artisan from the appended drawings and the accompanying description.

DESCRIPTION OF THE PREFERRED EMBODIMENT

Figure 1:
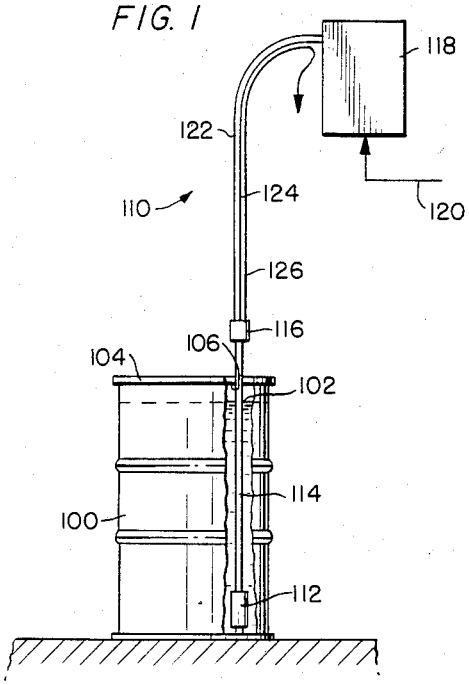
FIG. 1 is a side elevational view of an air operated diaphragm pump system constructed in accordance with the principles of the instant invention, said system being shown in operative association with a drum filled with liquid.

Turning now to the drawings, FIG. 1 depicts a large metallic drum 100 having a capacity of 80 gallons. The liquid level line is indicated by dotted line 102, and a fragment of the drum has been removed to show the interior thereof. A lid 104 seals the open upper end of drum 100, and an aperture 106 is formed through the lid.

An air-operated, diaphragm pump assembly, indicated generally by reference numeral 110, is operatively connected to the drum 100 for draining its contents in a unique and highly efficient manner. The assembly 110 comprises a diaphragm pump 112 positioned on, or closely adjacent to, the bottom of drum 100, an extension sleeve 114 projecting upwardly from the pump 112 through the aperture 106, and a collar 116 secured to the upper end of the extension sleeve. The diaphragm pump assembly further includes a pulse generator 118, an air supply line 120 for delivering pressurized air to the pulse generator, and two conduits 122, 124 which extend from the pulse generator, through collar 116 and extension sleeve 114, and into communication with pump 112. A third conduit 126 leads upwardly from pump 112, through extension sleeve 114, collar 116 and terminates at delivery point 128. The conduits are maintained substantially parallel to one another by banding straps (not shown) and by the collar 116 which guides the conduits into extension sleeve 114 and toward diaphragm pump 112. The sleeve protects the conduits from attack by the liquid contained in the drum.

Figure 2:
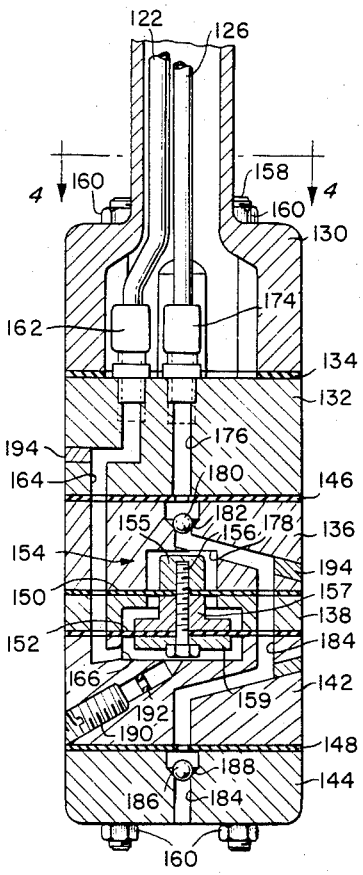
FIG. 2 is a vertical cross-sectional view through the diaphragm pump of FIG. 1, such view being taken on an enlarged scale.
Figure 3:
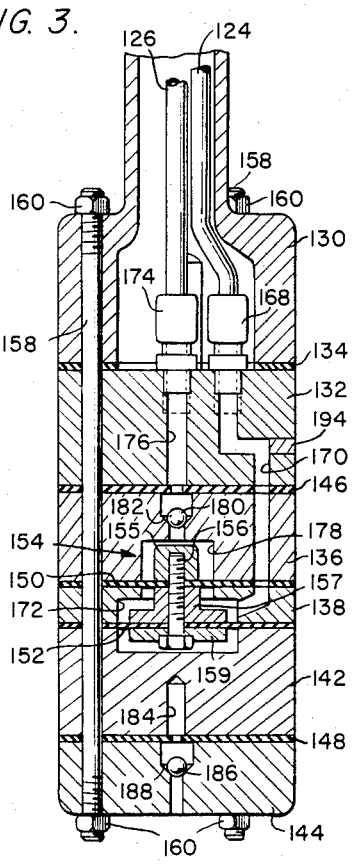
FIG. 3 is another vertical cross-sectional view through the diaphragm pump of FIG. 1, such view being taken in a plane perpendicular to the view of FIG. 2 and on an enlarged scale.

FIGS. 2 and 3 are vertical cross-sectional views of the air operated diaphragm pump 112 taken at right angles to one another. The pump 112 includes a body, formed of a plastic, such as polypropylene. The body is comprised of distinct segments such as a cap 130, an upper body segment 132, a first sealing gasket 134 retained between the cap 130 and segment 132, intermediate body segments 136 and 138, lower body segment 142, and base 144. A second sealing gasket 146 is retained between body segments 132 and 136, and a third sealing gasket 148 is retained between lower body segment 142 and base 144.

A first flexible diaphragm 150 is retained between body segments 136 and 138, and a second flexible diaphragm 152 is retained between body segment 138 and body segment 142. Diaphragm 150 is deemed to be a pumping diaphragm, while diaphragm 152 is deemed to be a driving diaphragm. The reasons for such terminology will become evident at a later point in the specification.

Figure 5:
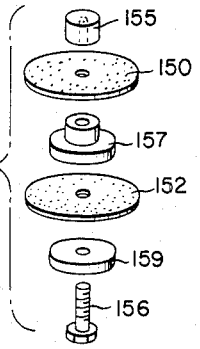
FIG. 5 is an exploded perspective view of the displacer employed within the diaphragm pump of FIGS. 2–4.

A displacer, indicated generally by reference numeral 154, is joined to diaphragms 150 and 152 by a threaded screw 156 which extends upwardly into a central bore. As seen in FIGS. 2 and 3, and particularly in FIG. 5, the displacer comprises a cap 155, a spacer 157, and a clamping plate 159. The head of screw 156 projects below the surface of clamping plate 159. The displacer 154 responds to differential pressures exerted upon the diaphragm 150 and 152. Displacer 154 is shown in its assembled condition in FIGS. 2 and 3, and is prior to assembly in FIG. 5.

Figure 4:
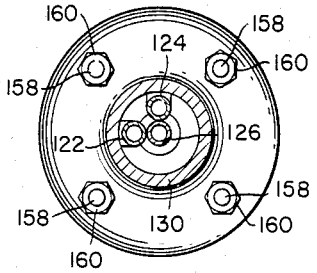
FIG. 4 is a top plan view of the diaphragm pump of FIG. 2.

Four vertically extending rods 158 pass through openings in each body segment, gasket, and diaphragm; each rod is threaded at its opposite ends and nuts 160 are placed thereon. By tightening the nuts 160, the pump 112 is retained in assembled, operative condition and the sealing gaskets keep the interior of the pump leak-free. FIG. 4 is a top plan view of the air-operated, diaphragm pump 112, such view being taken along lines 4—4 in FIG. 2 and in the direction indicated.

The vertically oriented extension sleeve 114 is integrally formed with the cap 130 of the pump, and conduits 122, 124 and 126 pass through extension sleeve 114 into the cavity defined in the cap 130. Conduit 122 is secured to coupling 162, and the coupling is seated within the upper end of a passage 164 that leads downwardly through apertures in gasket 146, diaphragms 150 and 152, and terminates in a chamber 166 that communicates with the lower face of diaphragm 152. Conduit 124 is secured to coupling 168, and the coupling is seated with the upper end of a passage 170 that leads downwardly through apertures in gasket 146 and diaphragm 150 and terminates in a chamber 172 defined between the upper face of diaphragm 152 and the lower face of diaphragm 150.

Conduit 126 is secured to a coupling 174, and the coupling is seated within the upper end of a central passage 176 that leads downwardly through gasket 146 to a pumping chamber 178 defined above diaphragm 150 in intermediate section 138. A first ball valve 180 is normally seated upon valve seat 182 to block communication between chamber 178 and passage 176. An inlet passage 184 leads upwardly through the base 144, through an aperture in gasket 148, through segment 142, diaphragm 152, segment 138, diaphragm 150 and thence beyond valve seat 182 for communication with passage 176 and pumping chamber 178. A second ball valve 186 is normally seated upon valve seat 188 to prevent fluid drawn beyond the valve seat from flowing back into the drum from whence it was withdrawn.

An adjustment screw 190 is located in the pump body within a threaded passageway that opens into chamber 166. The screw can be advanced within the passageway so that its inner end projects into the chamber 166 toward the head of fastener 156, thereby limiting the diaphragm stroke. A sealing ring 192 fits about the shank of the screw, so that the chamber 166 is maintained leak-free. Plugs 194 are employed to seal the internal passages in the body of the pump.

Figure 6:
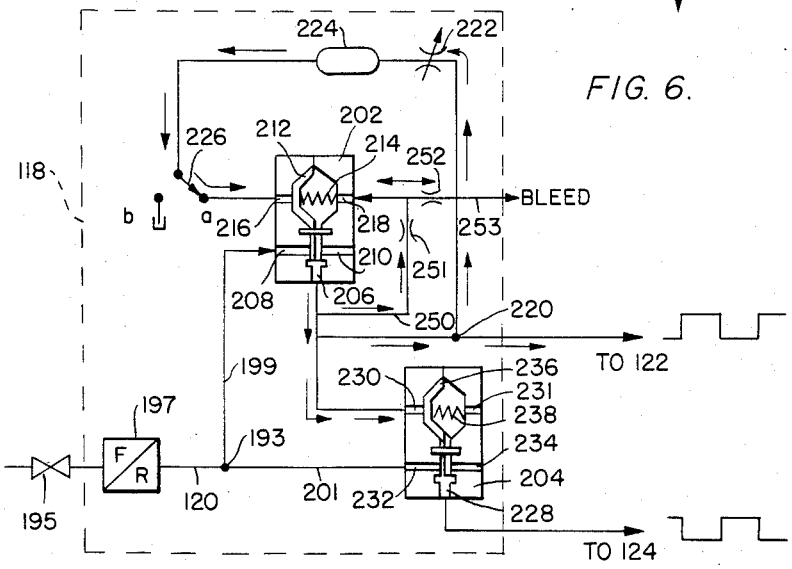
FIG. 6 is a schematic view of the logic circuitry for the diaphragm pump system.

FIG. 6 schematically shows the pneumatic logic circuitry for pulse generator 118 that operates the diaphragm pump 112 in a manner that will withdraw almost all of the fluid retained in drum 100 at very low flow rates. The logic circuitry is secured within the housing for pulse generator 118, and the pulse generator is retained in a fixed position at a location remote from the drum 100.

The pulse generator receives compressed air at above atmospheric pressures over supply line 120. A valve 195 is adjusted to admit the compressed air to the pulse generator, and a combined filter and pressure reducer 197 prevents particles in the flow line from clogging the logic circuitry as well as stepping down the pressure level in the supply line to a level compatible with the operating parameters of the logic circuitry. The compressed air leaving filter and pressure reducer 197 over line 120 flows into a T coupling 193 and divides into first supply line 199 and second supply line 201. Supply lines 199 and 201 introduce the compressed air into pneumatic logic elements 202 and 204, respectively.

Figure 7:
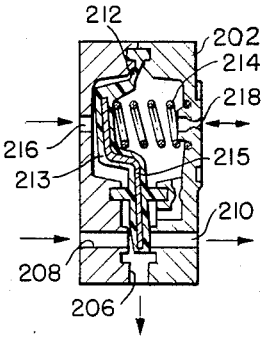
FIG. 7 is a schematic view, on an enlarged scale, of a bi-stable element utilized within the logic circuitry of FIG. 6.

Logic elements 202 and 204 may assume diverse forms, including pure fluid components with no moving parts or hybrid elements combining fluid flow techniques with toggles, switches, deflectors, and other mechanical control elements. Logic elements 202 and 204 are commercially available components that may be purchased from Samson A G of Frankfurt, W. Germany or from Samsomatic Ltd., Fairfield, N.J., U.S.A. Logic element 202 is the pneumatic analogue to a Schmitt-Trigger or bistable flip flop, while logic element 204 is a pneumatic inverter. The structural details of logic element 202 are shown in FIG. 7, and the inverter 204 is similar in design.

Logic element 202 includes supply channel 208, outlet channel 206, vent channel 210, and toggle element 212. The toggle may assume many forms and yet function with equal facility; in the exemplary embodiment, the toggle is driven by a membrane 213 reinforced by a metal insert 215; in all instances, however, the element must be capable of flexing quickly between two stable states. A spring 214 normally biases the toggle to one of its two stable states, and control ports 216, 218 are located on opposite sides of the membrane 213. Control pulses are introduced at port 216. The position of the toggle element determines whether outlet channel 206 receives compressed air pressure or vents to atmosphere through channel 210. In the circuit shown in FIG. 6, the spring 214 normally biases the toggle to its extreme left hand position. When pressure is present at outlet channel 206, air will pass via conduit 250 and restrictions 251 and 252 to bleedline 253. Depending upon the relative values of the restrictions, air pressure will act on membrane 213 to assist in retaining the toggle element 212 in its present position.

If control pressure is built up at control port 216, the toggle element will only shift to its other stable position, if this control pressure is high enough (0.85 Bar) to overcome both the spring 214 and the pressure at control port 218.

Once the toggle element begins to move, outlet channel 206 will vent to atmosphere via outlet channel 210. The pressure at port 218 will drop to zero and the toggle element will move rapidly to its new position. Such Schmitt-Trigger action causes switching of logic element 202 at exactly predetermined pressures at control port 216.

As shown in FIG. 7, restrictions 251 and 252 form an integral part of the pneumatic Schmitt-Trigger 202, as available from Samsomatic.

FIG. 6 schematically represents the normal flow paths for the pressurized air passing through the logic circuitry. Spring 214 biases toggle element 212 to its "home" position, and the fluid flow in supply line 199 enters supply channel 208 and exits through outlet channel 206. Toggle element 212, in its home position, prevents communication between supply channel 208 and vent channel 210.

The flow emanating from outlet channel 206 enters coupling 220, and then divides into distinct paths. One path, as indicated by the elongated directional arrow, leads over conduit 122, through coupling 162, and through passage 164 to deliver a pulse of pressurized air to the chamber 166. The pulse of pressurized air, acting upon the enlarged head of the clamping plate 159 of displacer 154, is of sufficient magnitude to drive the displacer 154 and diaphragms momentarily upwardly. The movement of the membrane 150 within pumping chamber 178 forces liquid contained therein past ball valve 180 and discharges same through conduit 126 to delivery point 128. Chamber 178 will receive an initial charge of liquid when the pump is submerged.

A portion of the outlet flow from coupling 250 will enter a second path, or feedback loop, for logic element (Schmitt-Trigger) 202 and return over the loop to control port 216, as indicated by the smaller directional arrows in FIG. 6. The feedback loop includes a variable pneumatic resistor 222 and a pneumatic accumulator (or volume) 224; these elements are also conventional in design and are available commercially from several sources, including Samson A G. The setting for resistor 222 is adjusted to control the rate at which pressure increases within accumulator 224. The pressure in the accumulator increases until reaching the level of 0.85 Bar in one hardware implementation of the circuit of FIG. 6. At such level the corresponding pressure signal present at control port 216 is sufficient to overcome the bias of spring 214 and force the toggle element 212 to switch to its alternate stable position. In this alternate position, toggle element 212 prevents flow in supply channel 208 from reaching outlet channel 206. Channel 206 is vented to atmosphere via channel 210.

When outlet channel 206 drops toward a zero pressure level, the pressure in the accumulator 224 in the feedback loop diminishes as air escapes therefrom through resistor 222. When the pressure in accumulator 224 drops below 0.25 Bar, the toggle element 212 is snapped back to its "home" position by spring 214. Pressure is then re-established in outlet channel 206 at a level of 2 Bar. The cycle of alternately discharging fluid at a pressure of 2 Bar at outlet channel 210, and then venting the pressure to atmosphere via outlet channel 208 will repeat itself as long as switch 226 is closed. FIG. 6 shows the switch 226 in its normal, closed position, indicated as the "a" position. The switch is moved to its "b" position, when empty barrels are being removed and new barrels 100 of liquid are being connected to the instant system. With switch 226 in its "b" position, the pressure in accumulator 224 will not be reflected at control port 216; consequently, the Schmitt-Trigger will not alternate between its stable stages, but will continuously discharge fluid through outlet channel 210 at a pressure level of 2 Bar.

The remaining portion of the outlet flow from channel 206 travels over a third path and influences the operation of logic element 204. Logic element 204 performs an inversion function, and is identified as an inverter. The inverter is a conventional logic element available from Samsomatic AG. The inverter includes a supply channel 232, a control port 230, an aperture 231, outlet channel 228 and vent 234, a toggle element 236, and a spring 238 for biasing the toggle toward a home, or normal, position. The third flow path from channel 206 leads to the control port 230 of inverter 204. When a pressure signal is present in channel 206, such signal is manifested at control port 230 at a pressure level high enough to overcome the bias of spring 238 and force toggle element 236 to snap over center and assume its other stable state. When a pressure signal is absent from channel 206, no control signal is manifested at port 230, and spring 238 forces the toggle element to return to its home position, which is shown in FIG. 6.

The interconnection of the Schmitt-Trigger 202 and the inverter 204 produces pulse trains that approximate a square wave, as shown in FIG. 6. As indicated, when the pressure in outlet channel 206 of element 202 reaches its maximum, the pressure in outlet channel 228 of inverter 204 drops to its minimum. The pressure levels are reversed when flow through outlet channel 206 by movement of toggle element 212 and logic element 202 is vented to atmosphere over outlet channel 210.

These relationships of pressure pulses are shown by the traces of the pulse trains delivered from logic element 202 to conduit 122 and from logic element 204 to conduit 124. As noted previously, when the pulse from logic element 202 reaches its maximum pressure level, the pulse from interconnected logic element 204 is cut off and the pressure in chamber 172 drops to its lowest level. The pressure differential across the diaphragm 152 is thus maximized and the membrane 150 is driven forcefully through chamber 178 to expel liquid therefrom.

Furthermore, by altering the setting of variable resistor 222, the rate at which accumulator 224 is filled is varied, and the rate at which pulses appear at control port 216 is changed, and the rapidity at which toggle element 212 is switched between its stable states is similarly changed. The setting for resistor 222 therefor determines the rate at which fluid will be discharged at a constant rate by the air operated diaphragm pump system; such setting may be adjusted over a wide range of values with attendant changes in the discharge rate for the system.

The foregoing description of the air operated diaphragm pump system is but a preferred embodiment, and numerous modifications and revisions may occur to the skilled artisan. For example, the logic circuitry may assume diverse forms, including pure fluid components with necessary amplifiers. Also, if the delivery pressure of pump 112 is kept relatively low, inverter 204 might be omitted and the pressure in conduit 124 might be maintained at a constant pressure approximately one half of the maximum pressure in conduit 122.

The extension sleeve 114 may be formed as an integral part of the cap 130 of the pump body, or may be formed as a separate component which is subsequently secured thereto. The pulse generator 118 may be bolted or otherwise secured to a fixture secured to the lid 104 of the drum. The lid for the drum may be omitted, and the extension sleeve can be secured to the receptacle in another fashion to project vertically upwardly. The diaphragms 150, 152 may be formed from a wide variety of long lived, flexible materials, such as natural rubber or fluoroelastomers. Consequently, the appended claims should not be limited to their literal terms, but should be construed in a manner consistent with the material advance in the useful arts and sciences represented by the present invention.

What is claimed is:

1. In combination, an upwardly opening receptacle, liquid stored within said receptacle, a lid for said receptacle, said lid having an aperture formed therethrough, and a diaphragm pump assembly for withdrawing the liquid from said receptacle, said assembly comprising:

(a) a diaphragm pump submerged within said receptacle below the level of the liquid, (b) said pump having a body with an inlet passage for admitting liquid, an outlet passage for discharging liquid and a pumping chamber intermediate said inlet and outlet passage for receiving liquid there, (c) a first valve controlling the admission of liquid into the pumping chamber and a second valve controlling the discharge of liquid from said pumping chamber, (d) a pair of spaced diaphragms extending within the pump body to define a first pressure chamber therebetween, (e) a displacer secured to said diaphragms, said displaced being movable within pumping chamber, (f) an extension sleeve extending vertically upwardly from the pump through the aperture in said lid to a position above the receptacle, (g) a pulse generator and a supply of compressed air for pressurizing same, said pulse generator comprising a circuit of interconnected pneumatic logic elements, at least one of said logic elements comprising a bistable element with two outlet channels, and said circuit further including an inverter connected to one of the outlet channels of said bistable element, and (h) inlet conduit means passing through said extension sleeve for connecting said pulse generator to said pump body to transmit pressurized pulses to said diaphragms for driving said plunger into said pumping chamber;

(i) outlet conduit means passing through said extension sleeve for discharging the liquid forced out of said pumping chamber in said pump body by said displacer.

2. In combination, an upwardly opening receptacle, liquid stored within said receptacle, a lid for said receptacle, said lid having an aperture formed therethrough, and a diaphragm pump assembly for withdrawing the liquid from said receptacle, said assembly comprising:

(a) a diaphragm pump submerged within said receptacle below the level of the liquid, (b) said pump having a body with an inlet passage for admitting liquid, an outlet passage for discharging liquid and a pumping chamber intermediate said inlet and outlet passage for receiving liquid there, (c) a first valve controlling the admission of liquid into the pumping chamber and a second valve controlling the discharge of liquid from said pumping chamber, (d) a pair of spaced diaphragms extending within the pump body to define a first pressure chamber therebetween, (e) a displacer secured to said diaphragms, said displaced being movable within pumping chamber, (f) an extension sleeve extending vertically upwardly from the pump through the aperture in said lid to a position above the receptacle, (g) a pulse generator and a supply of compressed air for pressurizing same, (h) inlet conduit means passing through said extension sleeve for connecting said pulse generator to said pump body to transmit pressurized pulses to said diaphragms for driving said plunger into said pumping chamber, said inlet conduit means comprising a first and a second inlet conduit, said first conduit introducing pressure pulses into said first pressure chamber formed in said pump body to maintain said diaphragms under a constant tension, (i) outlet conduit means passing through said extension sleeve for discharging the liquid forced out of said pumping chamber in said pump body by said displacer, and (j) a second pressure chamber defined in said pump body, and said second inlet conduit introducing a pressure pulse into said second pressure chamber to flex said diaphragms, these pulses being at high pressure at the moment the pulse at the first pressure chamber is at low pressure.

3. The diaphragm pump assembly as defined in claim 2 wherein an adjustment screw is secured within said pump body to project into said second pressure chamber, said screw being manually adjustable to limit the stroke of said displacer.

* * * * *